United States Patent [19]

Duke

[11] 4,237,968

[45] Dec. 9, 1980

[54] HEAT EXCHANGER WITH DOUBLE WALL TUBES AND THREE TUBE SHEETS

[75] Inventor: James M. Duke, St. Petersburg, Fla.

[73] Assignee: Westinghouse Electric Corp., Pittsburgh, Pa.

[21] Appl. No.: 35,166

[22] Filed: May 2, 1979

Related U.S. Application Data

[63] Continuation of Ser. No. 810,816, Jun. 28, 1977, abandoned.

[51] Int. Cl.[3] ..... F28F 11/00

[52] U.S. Cl. ..... 165/70

[58] Field of Search ..... 165/70, 142, 173, 158; 122/32, 34

[56] References Cited

U.S. PATENT DOCUMENTS

| | | | |
|---|---|---|---|
| 2,658,728 | 11/1953 | Evans, Jr. | 165/83 X |
| 2,807,445 | 9/1957 | Gardner | 165/173 |
| 2,832,570 | 4/1958 | Schoessow | 165/70 |
| 3,963,071 | 6/1976 | Levin et al. | 165/142 |

FOREIGN PATENT DOCUMENTS

| | | | |
|---|---|---|---|
| 730284 | 5/1955 | United Kingdom | 165/70 |
| 960628 | 6/1964 | United Kingdom | 165/70 |

*Primary Examiner*—Samuel Scott
*Assistant Examiner*—Theophil W. Streule, Jr.
*Attorney, Agent, or Firm*—F. J. Baehr, Jr.

[57] ABSTRACT

A heat exchanger incorporating double-walled tubes utilizes three tube sheets to provide economical leak detection.

4 Claims, 3 Drawing Figures

HEAT EXCHANGER WITH DOUBLE WALL TUBES AND THREE TUBE SHEETS

This is a continuation of application Ser. No. 810,816, filed June 28, 1977, now abandoned.

BACKGROUND OF THE INVENTION

This invention relates to heat exchangers and more particularly to heat exchangers having double wall tubes and three tube sheets.

It is desirable to ensure the separation of heating and heated fluids in heat exchangers and depending on the compatibility of the fluids involved, the effort and expense expended to ensure the separation of these fluids varies. Double wall tubes with grooves in one of the walls at the interface have been proposed as a highly reliable method of maintaining the separation between the fluids. However, two tube sheet junctures are susceptible to leaks. Double tube sheets on each end of the tubes may be utilized to detect leaks at the tube-to-tube sheet juncture further decreasing the possibility of undetected leaks and admixing of the two fluids.

SUMMARY OF THE INVENTION

In general, a heat exchanger, made in accordance with this invention, comprises a shell, a plurality of double wall tubes having an inner wall portion and an outer wall portion, a single tube sheet adjacent one end of the tubes, and a pair of tube sheets adjacent the other end of the tubes. The pair of tube sheets are disposed in a spaced relationship with the inner wall of one end of the tubes terminating adjacent one of the tube sheets forming the pair and the outer wall of the one end of the tube terminating adjacent the other tube sheet of the pair.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
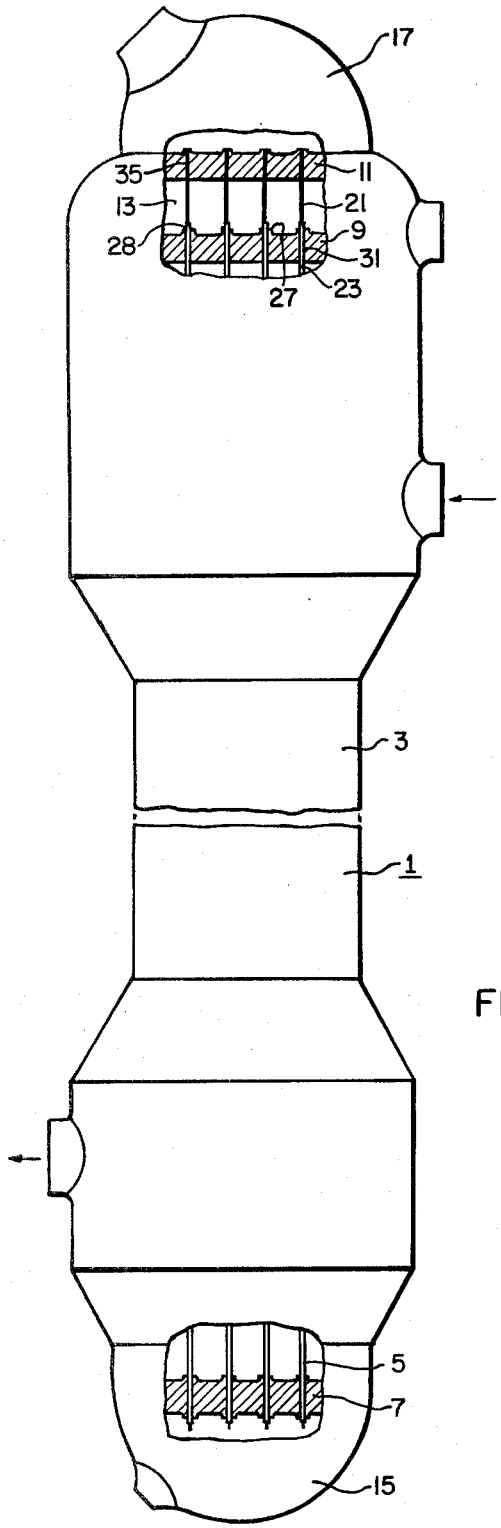
FIG. 1 is an elevational view, partially in section; of a heat exchanger made in accordance with this invention.

Referring now to the drawings in detail and in particular to FIG. 1, there is shown a heat exchanger 1 having an outer shell 3 and a plurality of double wall tubes 5. A single tube sheet 7 is disposed on one end of the shell 3, the lower end as shown in the drawings, and a pair of tube sheets 9 and 11 are disposed on the other end of the shell 3, the upper end as shown in the drawings. The tube sheets 9 and 11 are disposed in a spaced relationship and cooperate with the shell 3 to form an enclosed space 13 therebetween.

Hemispherical heads 15 and 17 are attached to the tube sheets 7 and 11, respectively, and cooperate therewith to form headers for directing the flow of fluid through the tubes 5. The shell 3 is expanded outwardly adjacent each end thereof to provide controlled flow paths for the influent and effluent shell side fluid.

The tubes 5 are double wall tubes which have a gap or one or more grooves 6 at the interface of the two walls.

Figure 2:
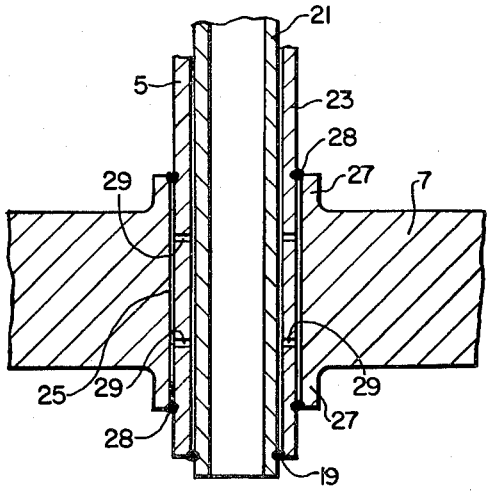
FIG. 2 is an enlarged partial sectional view showing the tube-to-tube sheet juncture with the single tube sheet; and, FIG. 3 is an enlarged partial sectional view showing the tube-to-tube sheet juncture with the pair of tube sheets.

One end of the tube terminates adjacent the single tube sheet 7 as shown in detail in FIG. 2. The end of the double wall tube 5 is sealed by forming a circumferential weld 19 at the interface of the inner and outer wall 21 and 23, respectively. The tube sheet 7 has a plurality of holes 25 for receiving the tubes 5 (only one is shown). Each hole has a boss 27 disposed at each end thereof to facilitate forming a seal weld 28 between the outer wall 23 and the boss 27 on both sides of the tube sheet 7. The portion or segment of the outer wall 23 between the welds 28 disposed within the holes 25 in the tube sheet 7 have one or more openings 29 disposed therein in communication with the grooves 6 to allow any fluid leaking past either of the seal welds 28 to enter the groove 6 so that it may be detected.

Figure 3:
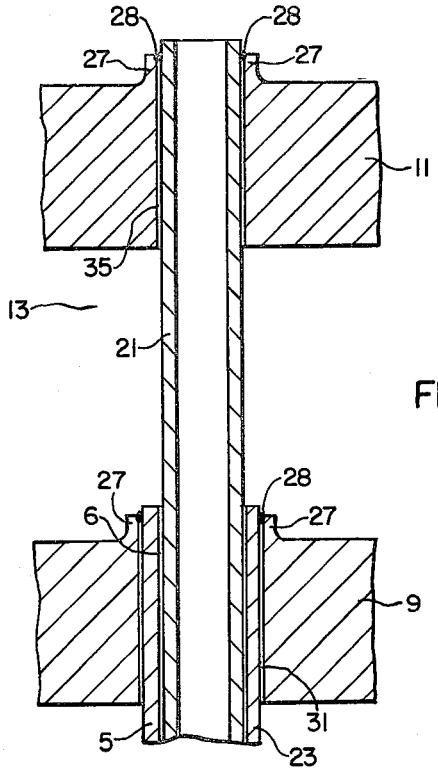

As shown in FIG. 3, the pair of tube sheets 9 and 11 are spaced apart and the inner tube sheet 9 has holes 31 for receiving the double wall tubes 5 and a boss 27 surrounding each hole to facilitate forming a seal weld 28 between the boss 27 and the outer wall 23 of the tube passing therethrough. The outer wall 23 terminates adjacent the inner tube sheet 9 and the inner wall 21 extends through the space 13 between the tube sheets 9 and 11 and through holes 35 in the outer tube sheet 11. Bosses 27 surround the holes 35 in the outer tube sheet 11 and facilitates forming a seal weld 28 with the ends of the inner wall 21 as it extends through the tube sheet 11. the grooves 6 at the interface of the inner and outer wall 21 and 23, respectively, is in communication with the space 13 between the tube sheets 9 and 11 and the space 13 serves as a header for collecting any leakage of either the heating or the heated fluid through either wall 21 or 23 of the tubes or through any of the sealed welds 28 between the tubes and the tube sheet giving an indication of a leak before there is contamination of one of the fluids by the other. The heat exchanger hereinbefore described advantageously utilizes only three tube sheets, yet provides an indication of leakage from any tube-to-tube sheet weld and any wall of the double wall tubes to assure separation of the heating and heated fluids.

What is claimed is:

1. A heat exchanger comprising a shell, a plurality of generally straight double wall tubes each tube having an inner wall portion and an outer wall portion which are contiguous, and at least one groove at the interface of the wall portions, said groove generally extending the length of the tube, a single tube sheet adjacent one end of the tubes and a pair of tube sheets adjacent the other end of the tubes, said pair of tube sheets being disposed in a spaced relationship to form an enclosed space, the inner wall portion of one end of the tubes terminating adjacent one of said pair of tube sheets and the outer wall portion of said tubes terminating adjacent the other of said pair of tube sheets and the groove being in fluid communication with the enclosed space, the outer wall portions of the tubes being sealed at the junctions between the outer wall portions and both side of the single tube sheet, and a segment of the outer wall portion within the single tube sheet having at least one opening extending therethrough and disposed in communication with the groove, whereby leak detection can be made in the enclosed space regardless of whether a leak occurs in either wall of the tube or at any weld between the tube and the tube sheet.

2. The heat exchanger as set forth in claim 1, wherein the seal is formed by welding.

3. The heat exchanger as set forth in claim 1, wherein the shell is expanded outwardly adjacent each end thereof.

4. The heat exchanger as set forth in claim 1, wherein the single tube sheet has bosses on each side surrounding each hole to facilitate seal welding the tubes to both sides of the tube sheet.

* * * * *